US009334735B2

(12) United States Patent
Killassy

(10) Patent No.: US 9,334,735 B2
(45) Date of Patent: May 10, 2016

(54) PRELOADABLE SUPPORT

(76) Inventor: Natalie Killassy, Potchefstroom (ZA)

( * ) Notice: Subject to any disclaimer, the term of this patent is extended or adjusted under 35 U.S.C. 154(b) by 0 days.

(21) Appl. No.: 14/001,323

(22) PCT Filed: Feb. 24, 2012

(86) PCT No.: PCT/IB2012/050851

§ 371 (c)(1),
(2), (4) Date: Aug. 23, 2013

(87) PCT Pub. No.: WO2012/114308

PCT Pub. Date: Aug. 30, 2012

(65) Prior Publication Data

US 2013/0336728 A1 Dec. 19, 2013

(30) Foreign Application Priority Data

Feb. 24, 2011 (ZA) ..... 2010/07656
Jun. 6, 2011 (ZA) ..... 2011/04188

(51) Int. Cl.
*E21D 15/44* (2006.01)
*E21D 15/48* (2006.01)

(52) U.S. Cl.
CPC ..... *E21D 15/445* (2013.01); *E21D 15/483* (2013.01)

(58) Field of Classification Search
USPC ..... 405/288, 289
See application file for complete search history.

(56) References Cited

U.S. PATENT DOCUMENTS

| | | | | |
|---|---|---|---|---|
| 2,990,166 | A * | 6/1961 | Walsh | 299/11 |
| 4,770,564 | A | 9/1988 | Dison | |
| 4,983,077 | A * | 1/1991 | Sorge et al. | 405/288 |
| 5,143,340 | A * | 9/1992 | Wood et al. | 248/354.2 |
| 6,547,492 | B1 * | 4/2003 | Degville | 405/289 |
| 6,558,085 | B1 * | 5/2003 | Hall | 405/288 |
| 8,021,083 | B2 * | 9/2011 | Skarbovig | 405/288 |
| 8,246,276 | B2 * | 8/2012 | Bower et al. | 405/289 |
| 8,414,226 | B2 * | 4/2013 | Skarbovig | 405/288 |
| 2006/0086885 | A1 | 4/2006 | Heath | |
| 2010/0104376 | A1 * | 4/2010 | Skarbovig | 405/232 |
| 2013/0129426 | A1 * | 5/2013 | Skarbovig | 405/288 |

OTHER PUBLICATIONS

International Search Report from International Application No. PCT/IB2012/050851 mailed Aug. 9, 2012.

* cited by examiner

*Primary Examiner* — Benjamin Fiorello
(74) *Attorney, Agent, or Firm* — Dorsey & Whitney LLP

(57) ABSTRACT

The invention relates to a load support (1) comprising a container (2) manufactured from a flexible material, having at least one side wall (4), a top panel (3), a bottom panel (5), and a filler aperture (13). The side wall (4) has a predetermined height selected to be greater than the installation height of the support (1), operatively to allow for vertical expansion of the top of the container (2) into contact with the roof upon filling of the container (2) with a filler material.

25 Claims, 3 Drawing Sheets

PRELOADABLE SUPPORT

FIELD OF THE INVENTION

This invention relates to a load support, in particular an underground mine support, a structural support and an open cavity support.

BACKGROUND TO THE INVENTION

Support is often required for loads bearing onto surfaces over areas where closure of the load bearing surface onto the underlying base has to be prevented or controlled. This is the case in underground mining, and in emergency and rescue operations conducted in earth quake zones where structures such as buildings, bridges and some geological formations become unstable, and have to be supported at least temporarily to allow for such operations to be safely conducted. Supports are also required permanently in the case of underground mine supports.

A problem in such situations is that often a load may shift and may further endanger the lives of people trapped in such areas, or emergency and rescue personnel attending to such scenes. In the mining industry the occurrence of such situations are not emergencies but is the result of the mining operations. However, if not handled properly it can lead to enormous danger and loss of life.

In particular, during underground mining operations huge volumes of rock are removed which leaves equivalent sized open spaces that need to be supported to prevent sudden and unexpected closure of such spaces by surrounding rock.

The space created by the removal of rock is bounded by a hanging wall, which is the "roof" of the space, and a foot wall, which is the "floor" of the space. Supports are used to keep the hanging wall and foot wall apart. These supports typically include temporary supports, short term supports and permanent supports.

Temporary supports include extendable metal supports which are used between the hanging wall and foot wall immediately in front of the working face. The temporary supports are installed as soon as possible after an area has been blasted and cleared and before further work, such as drilling, on the working face commences. Permanent wooden poles or short term supports can also be used and later a support bag can be inserted between the poles to provide permanent support Over time the temporary supports are replaced by short term supports, and then later on with permanent supports. These permanent supports include, for example, wooden support packs. Problems with wooden support packs include their cost, their weight and volume, and load capacity requirements.

An alternative to wooden support packs as permanent supports is geotextile bags. These may take the form of backfill bags, gulley packs and so forth.

Often the percolation of the bag is not in balance with the slurry mix which leads to shrinkage and later causes problems making contact with the hanging wall.

It is necessary for an underground mine support to experience a specific load before it is able to set and make contact with the hanging wall properly. This load is referred to a preload and it serves to pressurize the container sufficiently to expel excess fluid and to cause the container to be loaded to its optimum yield strength and increase the extent of contact, before the support is expected to accept full load.

A problem with existing containers used for underground mine supports is that these do not contact the hanging wall in an evenly distributed manner and experience shrinkage during setting, which also causes insufficient or no contact with the hanging wall. The uneven or insufficient contact with the hanging wall leads to unevenly distributed loads and inconsistent loads during curing or setting. This causes uneven preloading of the support, which results in the support not performing uniformly or sufficiently when under load.

In another solution non-permeable containers are used which are filled with a filler, such as a cementituous filler, that sets under pressure and over time. It is essential for such containers that the pressure be evenly distributed throughout the container to ensure even preloading and curing.

In this specification the phrase "stope design height" means the height to which a specific stope in a specific mine is specified to be developed. This is typically done by a mining engineer taking consideration of factors such as competence of the stope pillar and stope walls or stope supports, slenderness ratio of adjacent pillars, orebody dip, orebody thickness, hole depth capability of drilling machine, fragmentation characteristics of the ore, and level intervals in existing mines.

In this specification the phrase "cavity height" means the distance between a floor and a roof or between a top and a bottom of a cavity, whether temporary or permanent, in an area that requires support of a load bearing down on the roof or top of such cavity. The cavity may occur naturally, and may be man-made such as cavities under structures such as bridges, buildings, embankments and the like, and further includes cavities formed in such areas as a result of natural phenomena such as earth quakes, landslides, sinkholes and the like.

In this specification the phrase "installation height" means the mean vertical height between two vertically spaced apart surfaces, typically termed a floor and a roof, between which a support according to this invention is to be installed, and includes a stope design height and a cavity height as defined above.

OBJECT OF THE INVENTION

It is an object of the invention to provide a load support which at least partly overcomes the abovementioned problems.

SUMMARY OF THE INVENTION

In accordance with this invention there is provided an underground mine support operatively to be filled with a filler material, the support comprising a container manufactured from a flexible material, having at least one side wall, a top panel and a bottom panel, and a filler aperture; with the side wall having a predetermined height selected to be substantially similar to a stope design height in a mine stope where the support is to be installed, and the container including a upper panel extending between the operatively upper edge of the side wall and the top panel to allow for vertical expansion of the container upon filling with a filler material.

There is further provided for the upper panel to be secured to the edge of the top panel and the operatively upper edge of the side wall.

There is further provided for the upper panel to have a height less than the height of the side wall, preferably to have a height less than half the height of the side wall, and most preferably to have a height of less than 20% of the height of the side wall; alternatively for the upper panel to have a height of about 50 cm.

There is further provided for the upper panel to be manufactured from the same material as the rest of the container, alternatively from a different material that has a higher percolation rate than the material from which the rest of the container is manufactured.

There is further provided for the container to have a parallelepiped shape with four side walls, and preferably for the container to be cube shaped, and further preferably for the side walls to include external supporting ties proximate their corners.

According to an alternative feature of the invention there is provided for the container to have a right circular cylindrical shape, preferably a right circular cylindrical shape.

There is also provided for the filler aperture to be closable and to extend through the top panel, one of the side walls, or the upper panel of a side wall proximate its upper edge.

There is further provided for the container to be manufactured from a liquid permeable geotextile fabric, to optionally include a set of spatially separable mesh reinforcing panels within it, preferably including spacing means in use to vertically space apart the panels, further preferably for the spacing means to comprise at least one tie extending from the operatively upper mesh panel to the operatively bottom mesh panel and being connected to each mesh panel at a predetermined length to space adjacent mesh panels apart at a predetermined spacing from each other.

There is further provided for the ties to extend downwards from the upper edge of the side walls.

There is further provided for the mesh panels to be contained in a sealed container locatable within the support container, for the ties to extend from the mesh panels at least to the inside of the top surface of the sealed mesh container and for the top of the sealed mesh container to be secured to the top of the support container, preferably by means of ties.

There is still further provided for the ties from the mesh panels to extend through the top of the mesh container and to be connected at their free ends to the top of the support container.

There is still further provided for the support to have dimensions of about 1.5 m width, about 1.0 m depth and about 1.1 m height or manufactured according to other and predetermined specific mining stope design heights.

According to a further aspect of the invention there is provided for the support to include a single cylindrical side wall, for the reinforcing panels to comprise complimentary shaped circular mesh panels and for the support to include a plurality of equidistantly spaced apart supporting ties extending downwards from the upper edge of the side wall, with each tie being secured to each mesh panel at a predetermined distance from the top to vertically space apart the panels.

These and other features of the invention are described in more detail below.

BRIEF DESCRIPTION OF THE DRAWINGS

A preferred embodiment of the invention is described by way of example only and with reference to the accompanying drawings in which.

DETAILED DESCRIPTION OF THE INVENTION

An embodiment of an underground mine support is described by way of example. The principles which determine the success of the support in such an environment are equally applicable to other environments where load support is required, for example during emergency and rescue operations. Thus, although the example is directed towards an underground mine support, this example is not intended to limit the scope of the invention but only to explain it.

Figure 1:
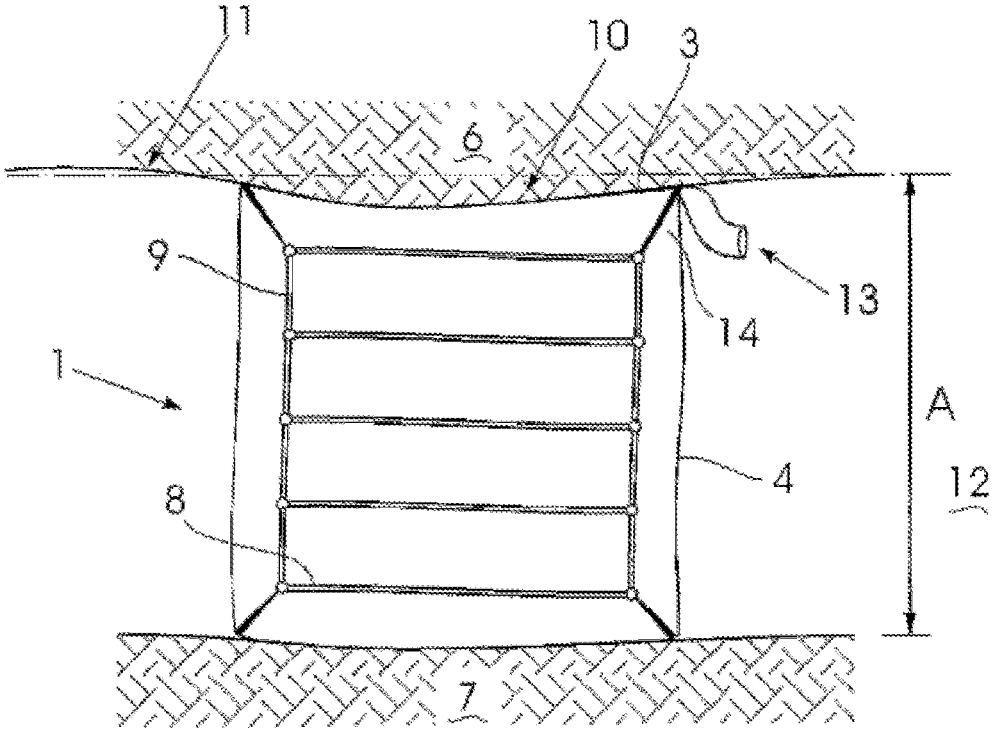
FIG. 1 is a sectional view of a first embodiment of an underground mine support according to the invention, and including a set of spatially separable mesh reinforcing panels within it, installed between a hanging wall and foot wall.
Figure 3:
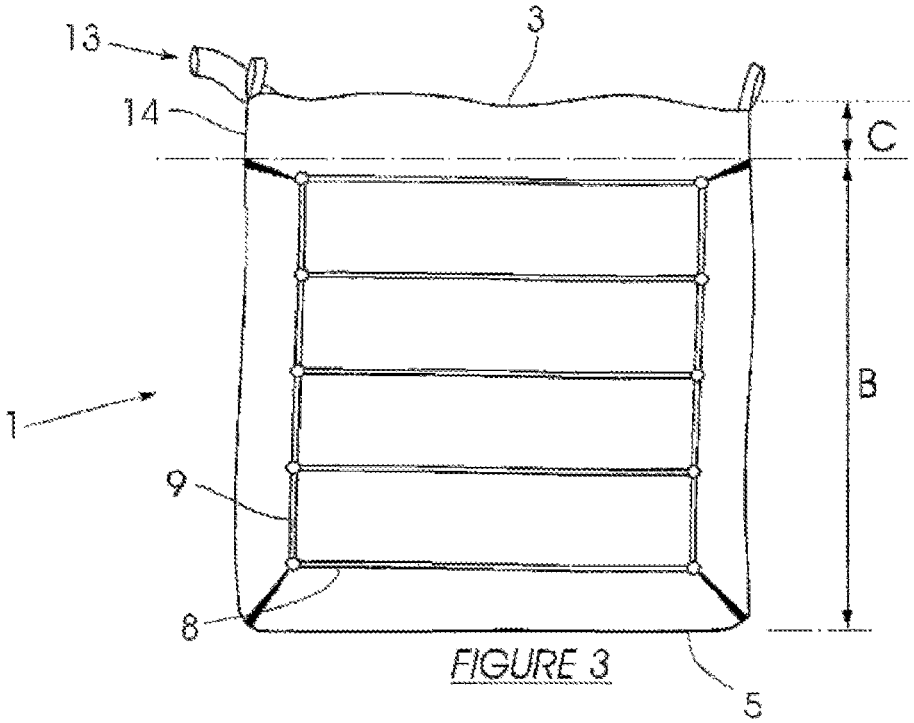
FIG. 3 shows a sectional view of the support of FIG. 1 with reference to the typical designed working height for such a support.
Figure 4:
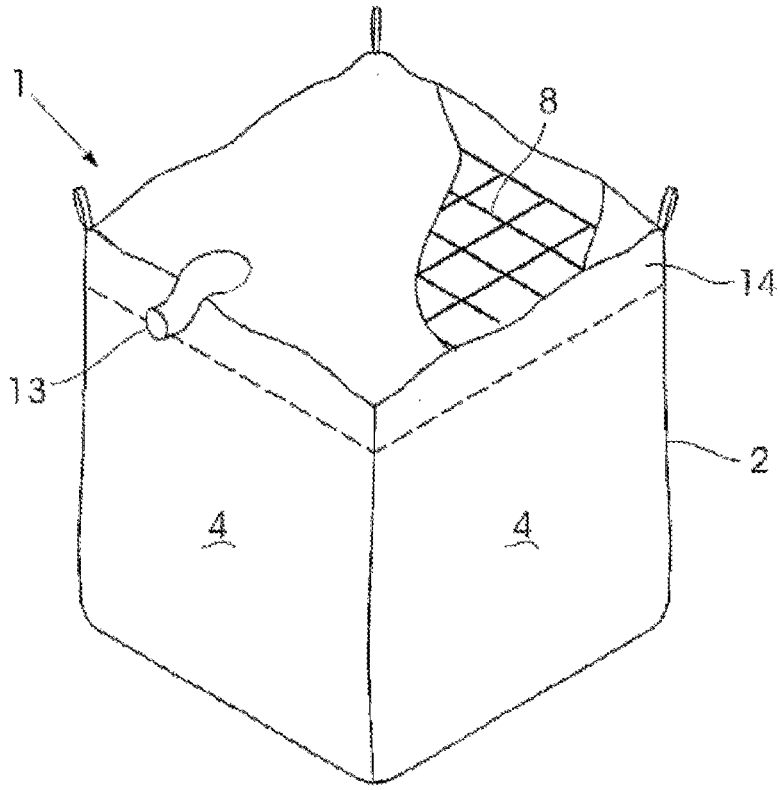
FIG. 4 shows a perspective view of the support of FIG. 1, with its top removed.

As shown in FIGS. 1, 3 and 4 a first embodiment of an underground mine support (1) according to the invention comprises a container (2) manufactured from a flexible material, in this instance a geotextile material. The container (2) has a parallelepiped shape with four substantially rectangular side walls (4), a top panel (3) and a bottom panel (5), and a filler aperture (13) in one of the side walls.

The side walls (4) have a predetermined height selected to be substantially similar to a stope design height between a hanging wall (6) and a foot wall (7) in an area (12) in a mine where the support is to be installed.

The side wall (4) comprises a main panel (4) and an upper panel (14). The upper panel (15) extends between the operatively upper edge (15) of the main panel (4) and the top panel (3) to allow for vertical expansion of the container (2) upon filling thereof, to accommodate an uneven hanging wall (6) surface.

The support (1) further includes a set of spatially separable mesh reinforcing panels (8) within it which are supported from each other by means of ties (9) with predetermined lengths extending between them. Each tie (9) is connected to the upper edge of the side wall (4). At predetermined locations along its length it is connected to each successive mesh panel (8). The ties (9) are located proximate corners of the mesh panels (8). When the container (2) is erected between the hanging wall (6) and foot wall (7) before filling, the mesh panels (8) are dropped into position and suspended by the ties (9) in a spatially separated manner.

Figure 2:
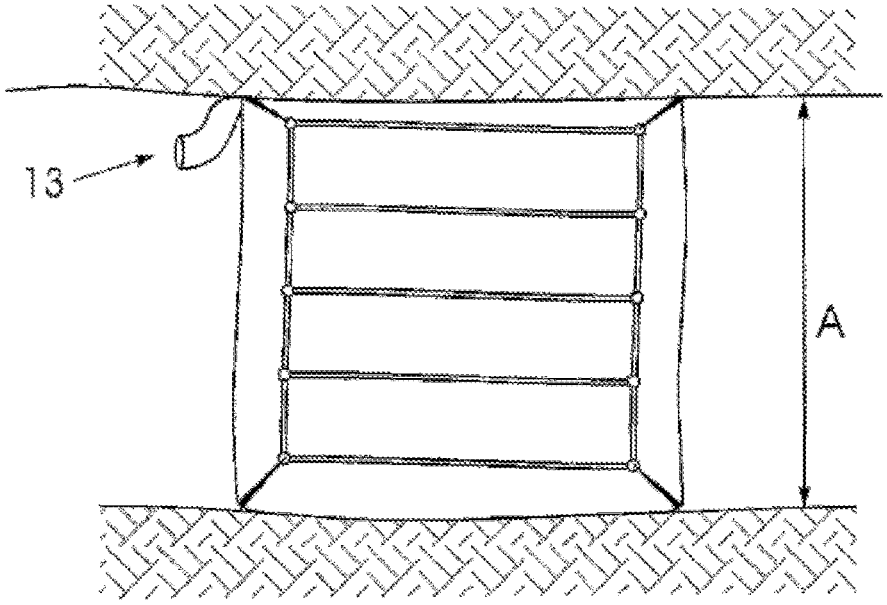
FIG. 2 shows a sectional view of the typical design working height of an underground mine support for use between a hanging wall and foot wall.

The support (1) is designed to work in an underground mine with a stope design height. This height is shown in FIG. 2 as dimension "A". The container (2) including its reinforcing mesh layers (8) is conventionally designed to fill this height accurately, or at least as accurately as possible with an uneven blasted roof. The mesh layers (8) have to be spaced apart with this height "A" in mind, and the total height of the container thus cannot be less than this height "A".

The support (1) is installed by filling it with a solid-liquid fluid in the form of slurry. The slurry is pumped into the container (2) through its filling aperture (13), and the liquid component of the slurry then drains through the pores of the geotextile material from which container is made. This leaves the solid component which sets in the container (2) to form a suitably strong support (1).

Pressure on the container (2), typically by means of this closure of the hanging wall (6) onto the container (2), which in effect is preloading of the support (1), is required for optimum performance of the support (1).

However, as shown in FIG. 1, hanging walls (6) in mine are far from even. This means that in some areas (10) the actual height may be somewhat less than the stope design height "A", as shown in FIG. 1, whereas in other areas (11) it may be greater. This means that with closure of the hanging wall (6) uneven pressure will be placed on the support (1) which results in uneven preloading and thus uneven yield strength throughout the support (1).

The uneven pressure is not evenly distributed through the container (2) as would be the case if the container (2) contained only liquid. With the presence of the solids and the mesh panels localized pressure differentials may result in localized strength differentials in the support (1) once it has set. It is possible that liquid may become trapped in areas of low preloading (low pressure), resulting in permanently weakened local sites in the support (1).

The areas (11) where the height is greater than the stope design height "A" will eventually close down onto the support (1) to meet it fully, but by then the lack of earlier closure (i.e. lack of preloading) may have already resulted in uneven preloading of the support (1) and entrapment of liquid.

As shown in FIG. 3, the support (1) according to the invention has a height that comprises the sum total of "B" and "C". Height "B" is the conventional height of the container (1), and corresponds with the stope design height "A". Height "B" is also the height of the main panel (4) of the container (2). The reinforcing mesh layers (8) extend no further than just below "B", which means the container (2) will still fit into a mine stope where the actual height (10) is somewhat less than the stope design height "A".

Height "C", the height of the upper panel (14), is added on top of the normal container height "B", and this allows the container (2) to be filled with filler material until it evenly contacts the hanging wall (6). Irrespective of the shape of the hanging wall (6), the top panel (3) of the container (2) rise under filling of the container (2) to match it. The top panel (3) closes the upper edge of the upper panel (14).

This allows the hanging wall (6) to exert even pressure on the top of the container (2) as it closes, and thus preloads the support (1) evenly.

The setting of the support (1) involves expelling as much as possible of the water contained in the slurry, to prevent weak areas from forming inside the support (1) once set. This could happen when water becomes trapped inside the container (2).

To optimize the water expulsion from the container (2), it is necessary to maintain contact between the top panel (3) and the hanging wall (6). The pressure is further kept up by continuing to pump slurry into the container (2).

The pressure inside the container (2) is further increased by keeping up the contact with the hanging wall (6). In deep mines closure of hanging wall (6) onto the foot wall (7) continuously happens. This closure will further pressurise the container (2), which also assists in getting rid of water and improves the setting rate and quality of the support (1). This combination of aspects thus ensures that the maximum amount of water is expelled from the container (2) during setting and in a shorter period of time than when contact is not maintained between the top panel and hanging wall (6).

In cases where the container (2) is manufactured from a liquid permeable geotextile material, the drainage of liquid from the container will occur in the normal manner and the container (2) can be filled to the top to meet the hanging wall (6) fully, thereby allowing it to set faster under closure from the hanging wall (6). This is the case in mines with deep working depths where closure is much faster due to the working depth.

Since closure is required to obtain sufficient strength from a support, the addition of the upper panel (14) aids in speeding up the time that it takes for a filled container to set into a fully functional support.

In mines which operate at lower depths, closure is not fast enough to ensure proper preload on these containers. These containers are thus filled with filler that sets out of its own accord, such as a cementituous filler. However, for such containers it is also necessary to ensure a proper match between the top of the container and the hanging wall, especially since the lower closure rates of the hanging wall means contact may not be established where there are large deviations from the design working height.

Figure 5:
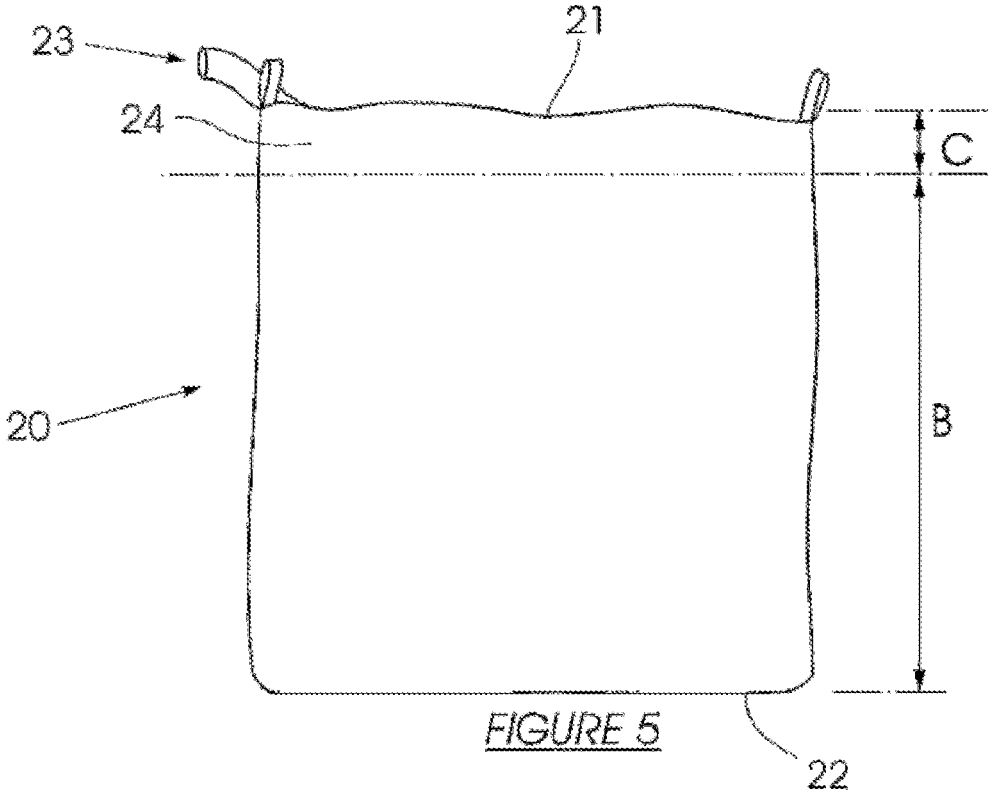
FIG. 5 shows a perspective view of a second embodiment of an underground mine support according to the invention installed between a hanging wall and foot wall, this embodiment not including a set of spatially separable mesh reinforcing panels.

In some instances a set of spatially separable mesh reinforcing panels within the container may not be required. Such an embodiment of an underground mine support (20) is shown in FIG. 5. Apart from the absence of the set of spatially separable mesh reinforcing panels, the container is the same of that shown in FIGS. 1, 3 and 4.

It will be appreciated that the embodiments described herein are given by way of example only and are not intended to limit the scope of this invention.

It is for example possible to use these designs with permeable and non-permeable containers, and whether these include reinforcing mesh layers or not, and whether they are filled with a filler which includes a self setting component or not.

It is also possible to provide the mesh reinforcing panels in a sealed container inside the support container, with ties extending from the top of the container to connecting points on the various mesh panels. The internal mesh bag will then be secured to the top of the support container, to be lifted up thereby enabling the mesh panels to adopt their spatial arrangement determined by the connecting ties.

The invention claimed is:

1. A load support, comprising:

a container manufactured from a flexible liquid permeable geotextile fabric, the container having:

at least one side wall;

a top panel;

a bottom panel; and a filler aperture;

wherein the at least one side wall includes a main panel having a predetermined height selected to be substantially similar to an installation height and an upper panel that extends generally vertically around the container and between an upper edge of a first section of the at least one side wall and the top panel, the main panel and the upper panel being manufactured from different liquid permeable geotextile fabrics, the upper panel being configured to allow vertical expansion of a top of the container into contact with a roof upon filling of the container with a filler material in a manner that conforms the top panel of the container to the shape of the roof.

2. The support as claimed in claim 1 in which the upper panel extends between an operatively upper edge of the main panel of the at least one side wall and the upper edge of the top panel.

3. The support as claimed in claim 2 in which the upper panel has a height less than the height of the main panel.

4. The support as claimed in claim 2 in which the upper panel has a height less than half the height of the main panel.

5. The support as claimed in claim 2 in which the upper panel has a height less than 20% of the height of the main panel.

6. The support as claimed in claim 2 in which the upper panel has a height of about 50 cm.

7. The support as claimed in claim 1 in which the liquid percolation rate of the upper panel differs from that of the main panel.

8. The support as claimed in claim 1 in which the liquid percolation rate of the upper panel is greater than that of the main panel.

9. The support as claimed in claim 1 in which the container has a parallelepiped shape with four side walls.

10. The support as claimed in claim 9 wherein a width is approximately 50% larger than a depth of the container and is approximately 40% greater than a height of the container respectively or dimensions manufactured according to a stope design height.

11. The support as claimed in claim 1 in which the container has a circular cylindrical shape.

12. The support as claimed in claim 11 in which the support has a right circular cylindrical shape.

13. The support as claimed in claim 11 wherein a diameter of the container is approximately 40% greater than a height thereof or dimensions manufactured according to a stope design height.

14. The support as claimed in claim 1 in which the filler aperture is closable and extend through the top panel or the upper panel of a side wall proximate its upper edge.

15. The support as claimed in claim 1 in which the container includes a set of spatially separable mesh reinforcing panels and spacing means operatively to vertically space apart the mesh panels, contained in a sealed mesh container locatable within the container.

16. The support as claimed in claim 15 in which the spacing means comprises at least one tie extending from the operatively upper mesh panel to the operatively bottom mesh panel and being connected to each mesh panel at a predetermined length to space adjacent mesh panels apart at a predetermined spacing from each other.

17. The support as claimed in claim 15 which includes a tie extending between adjacent spatially separable corners of the mesh reinforcing panels and being connected to each such corner to vertically space apart the mesh panels at a predetermined vertical spacing.

18. The support as claimed in claim 17 in which the ties extend downwards from at least the inside of a top surface of the sealed mesh container.

19. The support as claimed in claim 17 in which the ties from the mesh panels extend through the top of the mesh container and are connected at their free ends to the top of the support container.

20. The support as claimed in claim 15 which includes reinforcing panels that comprise complimentary shaped circular mesh panels and the support includes a plurality of equidistantly spaced apart supporting ties extending downwards from at least the inside of the top surface of the sealed mesh container, with each tie being secured to each mesh panel at a predetermined distance from the top to vertically space apart the mesh panels.

21. The support as claimed in claim 17 or 20 in which the mesh panels are equidistantly spaced apart.

22. The support as claimed in claim 20 in which the mesh panels are equidistantly spaced apart.

23. A method of installing a load support between a roof and floor collectively defining between them an installation height, including securing at least one tie extending from a support as claimed in claim 1 to the roof to suspend the empty support from the roof, filling the container with a filler material, allowing a liquid component of the filler material to drain from the container through the side wall, and continuing filling the container through the filler aperture until the top panel of the container abuts the roof and liquid is expelled from the top of the container through the upper panel of the side wall.

24. The method as claimed in claim 23 in which the container is filled with one or more of a cement, a slurry, a binder, or metal fragments.

25. A load support, comprising:

a container manufactured from a flexible material, the container including:

at least one side wall;

a top panel;

a bottom panel; and a filler aperture;

wherein the at least one side wall has a predetermined height selected to be greater than an installation height of the load support, operatively to allow for vertical expansion of a top of the container into contact with a roof upon filling of the container with a filler material;

wherein the container is manufactured from a liquid permeable geotextile fabric including at least one woven polypropylene; and wherein the at least one side wall includes a main panel and an upper panel that are manufactured from different woven polypropylene fabrics.

* * * * *